US010982517B2

(12) United States Patent
Al-Mulhem et al.

(10) Patent No.: US 10,982,517 B2
(45) Date of Patent: Apr. 20, 2021

(54) HYDROGEN PRODUCTION BY DOWNHOLE ELECTROLYSIS OF RESERVOIR BRINE FOR ENHANCED OIL RECOVERY

(71) Applicant: Saudi Arabian Oil Company, Dhahran (SA)

(72) Inventors: Abdulrahman Abdulaziz Al-Mulhem, Dhahran (SA); Mohammed A. Al-Daous, Thuwal (SA); Hussam A. Bahlouli, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 15/829,515

(22) Filed: Dec. 1, 2017

(65) Prior Publication Data

US 2019/0169969 A1 Jun. 6, 2019

(51) Int. Cl.
*E21B 43/20* (2006.01)
*E21B 43/30* (2006.01)
(Continued)

(52) U.S. Cl.
CPC ..... *E21B 43/20* (2013.01); *C25B 1/06* (2013.01); *E21B 43/16* (2013.01); *E21B 43/2401* (2013.01); *E21B 43/305* (2013.01)

(58) Field of Classification Search
CPC . E21B 43/20; E21B 43/16; C25B 1/06; C25B 1/00
See application file for complete search history.

(56) References Cited

U.S. PATENT DOCUMENTS 1,784,214 A * 12/1930 Workman ..... E21B 43/18 166/248
2,799,641 A 7/1957 Bell
(Continued)

FOREIGN PATENT DOCUMENTS

RU 2163662 C1 2/2001

OTHER PUBLICATIONS

Bellussi, et al., "Hydroconversion of heavy residues in slurry reactors: Developments and perspectives", Journal of Catalysis 308 (2013) 189-200.

(Continued)

*Primary Examiner* — Crystal J Miller
(74) *Attorney, Agent, or Firm* — Bracewell LLP; Constance G. Rhebergen; Linda L. Morgan

(57) ABSTRACT

Systems and methods of enhancing oil recovery with an electrochemical apparatus include introducing the electrochemical apparatus into an injection well bore. The electrochemical apparatus includes an anode, a cathode and an interior wall, the interior wall defining an interior that contains both the anode and the cathode. The electrochemical apparatus is operated such that injection water of the injection well bore is introduced into the interior of the electrochemical apparatus. Electrical power is introduced to the electrochemical apparatus such that a portion of the injection water is converted into a product gas, the product gas including hydrogen gas and oxygen gas. The electrochemical apparatus is operated such that the product gas forms product gas bubbles and the product gas bubbles travel into a formation, where the product gas bubbles react with a reservoir hydrocarbon of the formation to form a production fluid that is produced through a production well bore.

10 Claims, 4 Drawing Sheets

(51) Int. Cl.

| | |
|---|---|
| ***E21B 43/24*** | (2006.01) |
| ***E21B 43/16*** | (2006.01) |
| ***C25B 1/06*** | (2006.01) |

(56) References Cited

U.S. PATENT DOCUMENTS

| | | | | |
|---|---|---|---|---|
| 3,417,823 | A | 12/1968 | Faris | |
| 3,724,543 | A | 4/1973 | Bell et al. | |
| 3,782,465 | A | 1/1974 | Bell et al. | |
| 4,037,655 | A | 7/1977 | Carpenter | |
| 4,199,025 | A | 4/1980 | Carpenter | |
| 4,204,923 | A | 5/1980 | Carpenter | |
| 4,216,067 | A | 8/1980 | Mitchell | |
| 4,233,132 | A | 11/1980 | Carr et al. | |
| 4,919,201 | A | 4/1990 | Bridges et al. | |
| 5,452,763 | A | 9/1995 | Owen | |
| 6,342,152 | B1 | 1/2002 | Yoshita | |
| 7,241,950 | B2 * | 7/2007 | Fan | H01L 31/076 136/244 |
| 7,322,409 | B2 | 1/2008 | Wittle et al. | |
| 7,325,604 | B2 | 2/2008 | Wittle et al. | |
| 7,674,358 | B2 | 3/2010 | Gibson et al. | |
| 8,002,969 | B2 | 8/2011 | Hamad | |
| 8,156,954 | B2 | 4/2012 | Tao et al. | |
| 8,364,287 | B2 | 1/2013 | Pearson et al. | |
| 9,222,341 | B2 | 12/2015 | Noui-Mehidi | |
| 2005/0098443 | A1 | 5/2005 | Gomez | |
| 2006/0011472 | A1 | 1/2006 | Flick | |
| 2007/0000841 | A1 | 1/2007 | Harrington et al. | |
| 2008/0115930 | A1 * | 5/2008 | Peters | E21B 43/16 166/248 |
| 2009/0301717 | A1 * | 12/2009 | Lunde | C02F 1/4674 166/268 |
| 2012/0085535 | A1 * | 4/2012 | Mo | E21B 43/2401 166/272.1 |
| 2013/0105174 | A1 | 5/2013 | Noui-Mehidi | |
| 2013/0118735 | A1 | 5/2013 | Jamal et al. | |
| 2013/0312957 | A1 | 11/2013 | Grimes | |
| 2015/0027722 | A1 * | 1/2015 | Al-Mulhem | E21B 43/122 166/372 |
| 2016/0040519 | A1 | 2/2016 | Friesen et al. | |
| 2018/0320494 | A1 * | 11/2018 | Millar | C09K 8/592 |

OTHER PUBLICATIONS

Rana, et al., "A review of recent advances on process technologies for upgrading of heavy oils and residua", Fuel 86 (2007) 1216-1231.

Wilson, et al. "Hydrogen Production Using Solar Energy", Journal of Undergraduate Research in Physics, Mar. 17, 2013 (MS12030EXR).

Sawarkar, et al.,"Petroleum Residue Upgrading via Delayed Coking: A Review", The Canadian Journal of Chemical Engineering, Feb. 2007, pp. 1-24, vol. 85, India.

The International Search Report and Written Opinion for related PCT application PCT/US2018/063271 dated Mar. 14, 2019.

* cited by examiner

HYDROGEN PRODUCTION BY DOWNHOLE ELECTROLYSIS OF RESERVOIR BRINE FOR ENHANCED OIL RECOVERY

BACKGROUND OF THE DISCLOSURE

1. Field of the Disclosure

The field of the disclosure relates to enhancing oil recovery in a subterranean well. More specifically, the disclosure relates to using an electrochemical apparatus for improving the recovery factor of a hydrocarbon reservoir.

2. Description of the Related Art

Oil and gas can be produced from hydrocarbon reservoirs using the natural pressure stored in those reservoirs. The amount of oil recovered will depend on parameters such as the oil viscosity, reservoir wettability, reservoir pressure, and reservoir permeability.

Water production is a chronic problem in oil field operations that reduces the economic value of oil and gas assets. Aging oil fields face the challenge of producing "wet oil." Wet oil is a term for crude oil or condensate that has formation water entrained in it. In most cases, the material produced from a well is not all hydrocarbons. This water cut reduces the efficiency and effectiveness of the production system by bringing formation water to the surface. Eventually, the amount of water being produced reaches a level where the production well becomes uneconomical for further hydrocarbon production.

SUMMARY OF THE DISCLOSURE

Systems and methods of this disclosure electrolyze formation water with an electrochemical apparatus to produce gas, such as hydrogen, downhole in a shut-in well. The product gas will interact with the crude hydrocarbon in a formation and reduce the viscosity of the reservoir hydrocarbon by breaking down the heavy components of the reservoir hydrocarbon. The product gas can also alter the rock wettability making the rock more gas wet, and therefore improving the mobility of the reservoir hydrocarbon. The product gas can increase pressure in the formation, providing energy to the formation. Each of these effects of the product gas will increase the oil recovery factor. The use of water to form the product gas also reduces the adverse effect of water encroachment into oil and gas producing wells. The power for the electrochemical apparatus can be provided by solar photovoltaic panels so that no outside power source infrastructure is needed.

In an embodiment of this disclosure, a method of enhancing oil recovery with an electrochemical apparatus includes introducing the electrochemical apparatus into an injection well bore, where the electrochemical apparatus includes an anode, a cathode and an interior wall, where the interior wall defines an interior that contains both the anode and the cathode. The electrochemical apparatus is operated such that injection water of the injection well bore is introduced into the interior of the electrochemical apparatus. Electrical power is introduced to the electrochemical apparatus such that a portion of the injection water is converted into a product gas, where the product gas includes hydrogen gas and oxygen gas. The electrochemical apparatus is operated such that the product gas forms product gas bubbles and the product gas bubbles travel into a formation, where the product gas bubbles react with a reservoir hydrocarbon of the formation to form a production fluid that is produced through a production well bore.

In alternate embodiments, the production well bore can be spaced apart from and closer to an earth's surface than the injection well bore. A viscosity of the production fluid can be less than the viscosity of the reservoir hydrocarbon. A boiling point of the production fluid can be less than the boiling point of the reservoir hydrocarbon. A wettability of the formation can be altered with the product gas bubbles. Energy to the reservoir hydrocarbon can be provided with a pressure of the product gas bubbles. The electrical power can be provided from a solar photovoltaic panel.

In an alternate embodiment of this disclosure, a method of enhancing oil recovery with an electrochemical apparatus includes introducing the electrochemical apparatus into an injection well bore such that the electrochemical apparatus is located in a water bearing formation, where a fluid within the water bearing formation includes injection water, and where the electrochemical apparatus includes an anode, a cathode and an interior wall, where the interior wall defines an interior that contains both the anode and the cathode. The electrochemical apparatus is operated such that the injection water is introduced into the interior of the electrochemical apparatus. Electrical power is introduced from a solar photovoltaic panel to the electrochemical apparatus such that a portion of the injection water is converted into a product gas, where the product gas includes hydrogen gas and oxygen gas. The electrochemical apparatus is operated such that the product gas forms product gas bubbles and the product gas bubbles travel into a formation, where the product gas bubbles react with a reservoir hydrocarbon of the formation to form a production fluid that is produced through a production well bore, where the production well bore is spaced apart from and closer to an earth's surface than the injection well bore.

In alternate embodiments, a viscosity of the production fluid can be less than the viscosity of the reservoir hydrocarbon. A boiling point of the production fluid can be less than the boiling point of the reservoir hydrocarbon. A wettability of the formation can be altered with the product gas bubbles. Energy can be provided to the reservoir hydrocarbon with a pressure of the product gas bubbles.

In another alternate embodiment of this disclosure, a system for enhancing oil recovery with an electrochemical apparatus includes the electrochemical apparatus located in an injection well bore such that the electrochemical apparatus is located in a water bearing formation of the injection well bore, where a fluid within the water bearing formation includes injection water, and where the electrochemical apparatus includes an anode, a cathode and an interior wall, where the interior wall defines an interior that contains both the anode and the cathode. A fluid flow path extends from the injection well bore into the interior of the electrochemical apparatus. An electrical power source is operable to provide electrical power to the electrochemical apparatus such that a portion of the injection water is converted into a product gas that forms product gas bubbles, where the product gas includes hydrogen gas and oxygen gas. A production well bore has a production fluid formed from the product gas bubbles reacted with a reservoir hydrocarbon of a formation that is located in a path of the product gas bubbles.

In alternate embodiments, the production well bore can be spaced apart from and closer to an earth's surface than the injection well bore. A viscosity of the production fluid can be less than the viscosity of the reservoir hydrocarbon. A boiling point of the production fluid can be less than the boiling point of the reservoir hydrocarbon. The electrical power source can be a solar photovoltaic panel. The interior wall can include an electrically resistant coating. The electrochemical apparatus can further include an ion exchange membrane in the interior that separates the fluid between the anode and the cathode. The ion exchange membrane can be a cation exchange membrane.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the top limit and the bottom limit as well as the top limit and the bottom limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
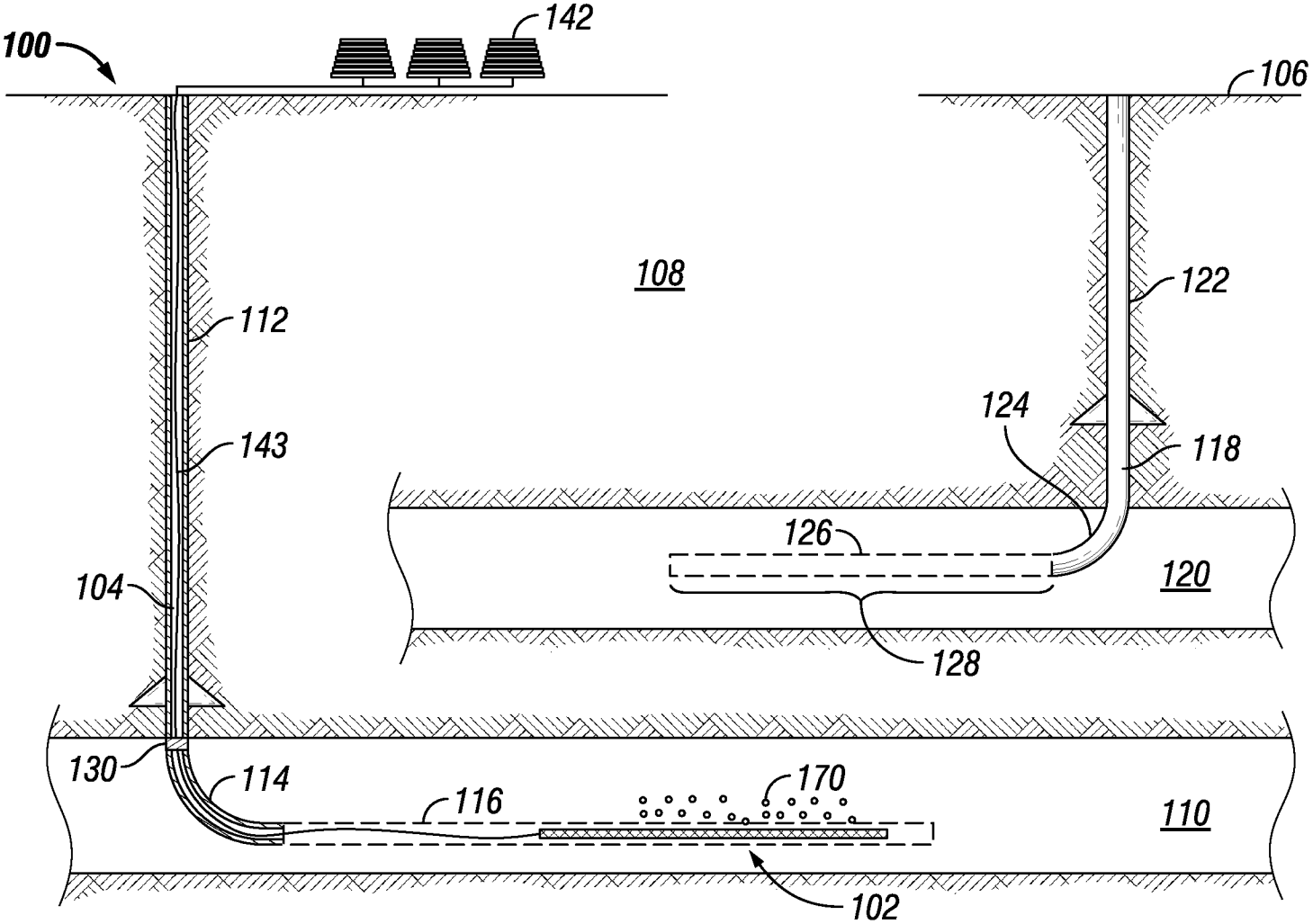
FIG. 1 shows an embodiment of an electrochemical system with an embodiment of an electrochemical apparatus in use in a horizontal well.

FIG. 1 shows a schematic layout of an example embodiment of a hydrocarbon development 100 that includes an electrochemical apparatus 102. Injection well bore 104 forms a pathway for equipment and tools, such as electrochemical apparatus 102, that traverse from surface 106, through non-hydrocarbon bearing formation 108 to water bearing formation 110. Injection well bore 104 has several sections, including vertical run 112, transition zone 114 and horizontal section 116. Horizontal section 116 extends in a generally horizontal direction from transition zone 114 until reaching the distal end of injection well bore 104 in relation to surface 106. The fluid within water bearing formation 110 that enters injection well bore 104 includes water.

Injection well bore 104 can be, for example, a well that has previously been a hydrocarbon production well that was shut-in due to an increased water cut so that the fluid in water bearing formation 110 no longer contains economically producible amounts of hydrocarbons. Alternately, injection well bore 104 can be a well that has been used for water injection so that water bearing formation 110 has been filled with water.

Injection water from water bearing formation 110 can enter injection well bore 104. Electrochemical apparatus 102 is shown located in injection well bore 104 within water bearing formation 110. Electrochemical apparatus 102 is operable to permit the introduction of fluid into the interior 129 (FIG. 2) of electrochemical apparatus 102 from injection well bore 104.

Electrochemical apparatus 102 is operable to produce product gas bubbles 170 from the injection water using electrical power. At least a portion of the injection water can be converted into product gas, which in turn forms product gas bubbles 170. Packer 130 can seal around an inner wall of injection well bore 104 so that the product gas bubbles 170 do not travel up injection well bore 104 to surface 106.

Production well bore 118 forms a pathway for equipment and tools, such as tools for producing fluids to surface 106, that traverse from surface 106, through non-hydrocarbon bearing formation 108 to hydrocarbon formation 120. Production well bore 118 is spaced apart from and closer to surface 106 than injection well bore 104. Production well bore 118 has several sections, including vertical run 122, transition zone 124 and horizontal section 126. Horizontal section 126 extends in a generally horizontal direction from transition zone 124 until reaching the distal end of production well bore 118 in relation to surface 106. Hydrocarbon formation 120 includes reservoir hydrocarbons that can enter production well bore 118. Horizontal section 136 includes production zone 128 that is operable to produce hydrocarbons that enter production well bore 118 to surface 106.

Surface systems associated with electrochemical apparatus 102 generate electrical power for delivering to electrochemical apparatus 102. The electrical power is used by electrochemical apparatus 102 to convert a portion of the injection water into a product gas, where the product gas includes hydrogen gas and oxygen gas. The electrical power can be generated by solar photovoltaic panel 142. The electrical power generated by solar photovoltaic panel 142 can be delivered directly to electrochemical apparatus 102 by way of cable 143 without first being converted by a turbine or other power transfer device. Cable 143 extends from solar photovoltaic panel 142 to electrochemical apparatus 102, delivering current generated by solar photovoltaic panel 142 to electrochemical apparatus 102.

Figure 2:
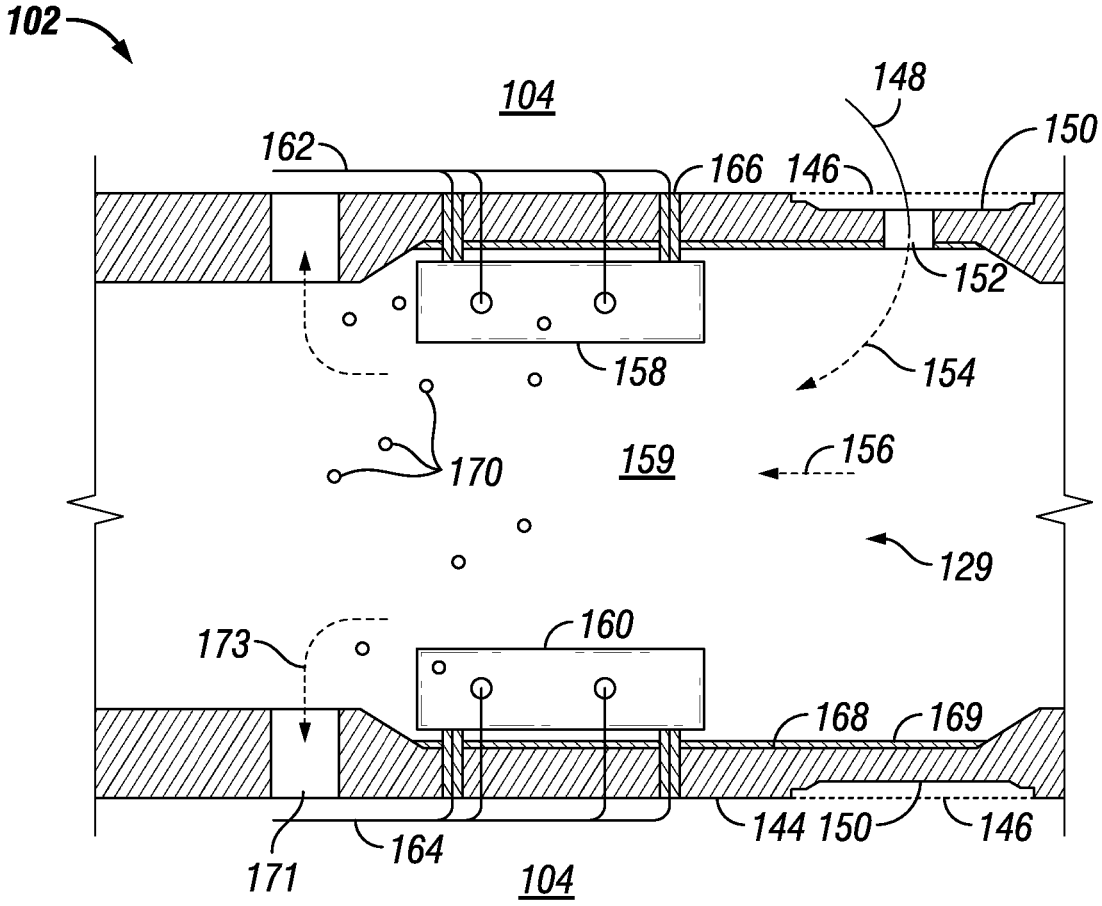
FIG. 2 shows an embodiment of an electrochemical apparatus in use in a horizontal well.

Looking at FIG. 2, electrochemical apparatus 102 has a hard and solid exterior cover 144 that protects a portion of the exterior of electrochemical apparatus 102. The remaining portion of the exterior of electrochemical apparatus 102 is mesh sand screen 146. Fluid from injection well bore 104, shown as solid arrow 148, passes through mesh sand screen 146 into fluid collection recess 150 beneath mesh sand screen 146 and passes through inlet 152 into the interior of electrochemical apparatus 102, as shown by dotted arrow 154. Mesh sand screen 146 prevents sand and other fine particles from entering the interior of electrochemical apparatus 102. In certain embodiments, inlet 152 can be managed and moved between open, throttled and closed positions, based upon the conditions present in injection well bore 104 and water bearing formation 110, including the amount of formation water present.

Fluid from injection well bore 104, including formation water 159, introduced into electrochemical apparatus 102 starts flowing generally in an uphole direction, as shown by arrow 156. The uphole drive is due to differential pressure between the surface and conditions downhole.

The interior 129 of electrochemical apparatus 102 contains two opposing plates: anode plate 158 and cathode plate 160. Anode plate 158 and cathode plate 160, upon the introduction of electrical power, operate to produce an electrical potential in formation water 159 located between anode plate 158 and cathode plate 160. Anode power conduit 162 and cathode power conduit 164 separately couple and supply power to anode plate 158 and cathode plate 160, respectively. Anode power conduit 162 and cathode power conduit 164 are part of cable 143. Insulated supports 166 offset each anode plate 158 and cathode plate 160 from interior wall 168 to prevent electrical grounding. Interior wall 168 includes electrically resistant coating 169 that insulates interior wall 168 from the electrical potential generated by anode plate 158 and cathode plate 160. Anode power conduit 162 and cathode power conduit 164 enter electrochemical apparatus 102 through insulated supports 166.

Upon application of electrical power, the electrical potential is generated. At least a portion of the formation water 159 of the fluid within electrochemical apparatus 102 converts into product gas, such as hydrogen and oxygen. The product gas forms product gas bubbles 170 on each anode plate 158 and cathode plate 160. The product gas bubbles 170 eventually detach into the fluid flow through electrochemical apparatus 102. The product gas bubbles 170 can exit electrochemical apparatus 102 though exit openings 171 as shown by arrow 173. The oxygen gas will be scavenged by minerals in the brine thus will cause no safety related issues.

Figure 3:
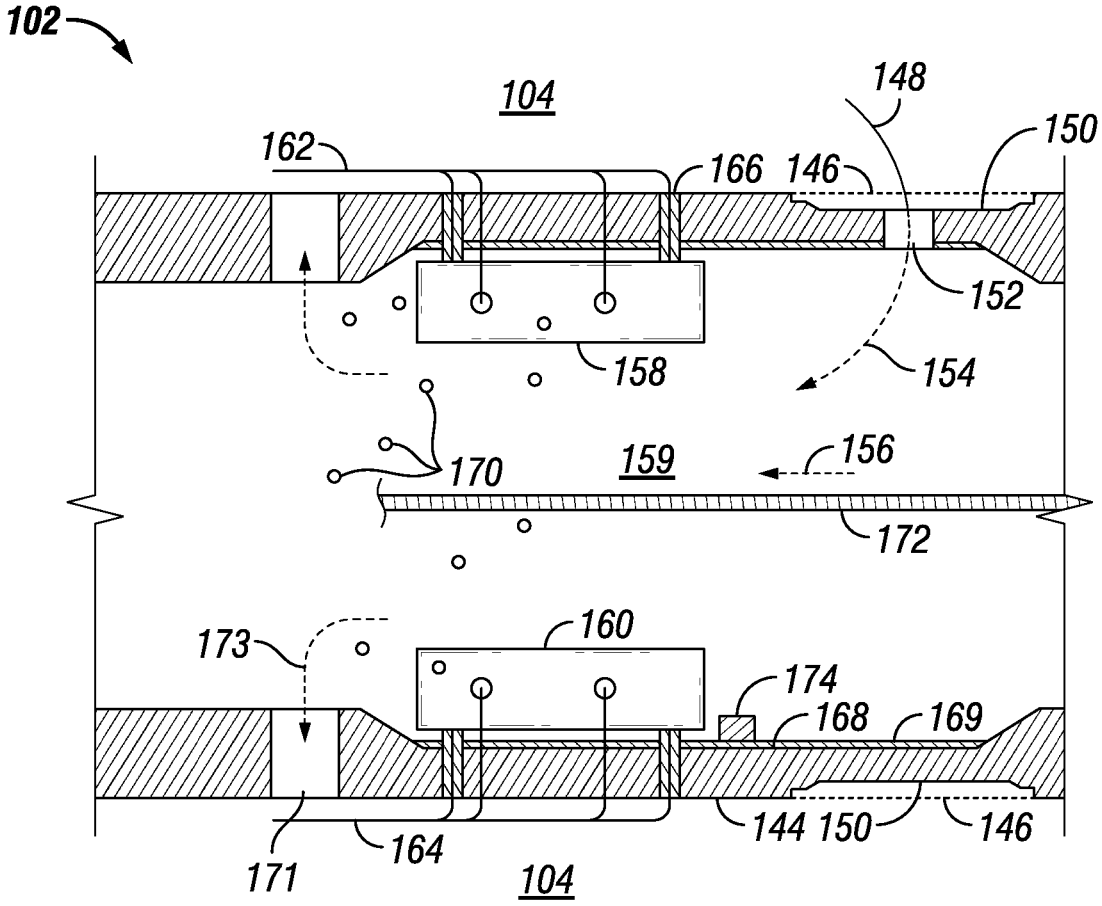
FIG. 3 shows an alternate embodiment of an electrochemical apparatus in use in a horizontal well.

Looking at FIG. 3, an embodiment of electrochemical apparatus 102 includes ion exchange membrane 172 in the interior 129 that separates fluid between anode plate 158 and cathode plate 160. Ion exchange membrane 172 is operable to permit only ions to pass between the electrodes. Ion exchange membrane 172 restricts the free-flow of non-ions, including water, dissolved salts, minerals and hydrocarbons, through the membrane. Preventing unencumbered flow between the electrodes prevents the formation of undesirable reaction products that can damage the electrodes and electrochemical apparatus 102.

Electrochemical apparatus 102 can include sensor 174 that is operable to detect a condition and to transmit a signal associated with the detected condition. A detectable condition includes the presence of certain fluids or other selected components in the fluid of interior 129. Examples of useful sensors and data-acquisition tools include sensors and tools that can detect electrical resistivity, electrical conductivity, capacitance, ultrasonic, pH, temperature and pressure.

Electrochemical Apparatus

Electrochemical apparatus 102 is operable to withstand hydrocarbon-bearing fluid, formation water, salts, minerals, brine, sulfurous gases, bumping into rock formations and alkaline or acidic conditions downhole. The body of electrochemical apparatus 102 is made of a material that is operable at the temperatures found downhole, such as up to 170 degrees Celsius (° C.), and is resistant to chemical attack, including halogen gases at elevated downhole temperature and pressure and the solvating effects of the hydrocarbon-rich environment. Useful materials include metal alloys such as HASTELLOY (Haynes Intl; Kokomo, Ind.), MONEL and INCONEL (Special Metals Corp.; New Hartford, N.Y.); fluoropolymers such as polytetrafluoroethylene (PFTE), perfluoroalkoxy polymers (PFA), polyether ether ketone (PEEK) polymers, fluorinated ethylene propylene polymers (FEP), polyetherimides (PEI) and ethylenetetrafluoroethylene (ETFE) polymers; carbon, stainless steel and steel with a reduced amount of alloys coated or clad with fluoropolymers; fluorinated or chlorinated synthetic rubbers, silicones, and polymer gasket rings and sealants; titanium alloys; nickel alloys; and certain classes of thermosetting polymers like polyimides, polycarbonates and epoxy resins.

Electrically resistant coating 169 can be formed of certain types of polymers, carbon fibers and ceramic materials that are chemically resistant to acidic or alkaline hydrocarbon environments and free-radical halogens. Useful types of these materials are also electrically resistant or electrically non-conductive. Such materials are useful proximate to and coupled with the electrodes and as components in the interior 129 of electrochemical apparatus 102. Adherence of the coating or materials to the interior wall can occur through a variety of known means, including spray coating, cladding and reactive bonding.

Components contacting, separating, shielding or in close proximity to the electrodes that are at least electrically resistant are useful to prevent grounding when the electrodes are generating the electrical potential. These components can be made of the same or different materials that make electrically resistant coating 169. For example, mounts that fix the location of the anode and the cathode within the interior 129 of electrochemical apparatus 102 may be made of a high-density polymer that is resistant to hydrocarbon swelling. Such mounts, which provide electrical insulation between the electrode and the body of electrochemical apparatus 102, may be drilled through and resealed to allow exterior electrical conduit to pass through the interior wall of electrochemical apparatus 102 and attach to each electrode. In such a manner, the electrode can receive power and yet remain electrically insulated from the remainder of electrochemical apparatus 102.

Electrodes

The electrodes include anode plate 158 and cathode plate 160, which couple to and are in electrical communication with a source of electrical power. Electrochemical apparatus 102 may have one or more pairs of electrodes. The electrode pair may be located as an electrode array within the interior 129 of electrochemical apparatus 102 to increase the exposure surface area for product gas generation. In an embodiment of the apparatus, anode plate 158 and cathode plate 160 are located downstream of inlet 152.

An embodiment of electrochemical apparatus 102 includes where the electrode pair is located within the interior 129 of the apparatus downstream of inlet 152. Internal housing of the electrodes protects the electrodes from the harsh physical and chemical conditions present in the production zone. Internal housing also provides protection from contacting well control fluids, the well bore wall and debris during introduction and positioning within the well bore. Locating the pair of electrodes downstream of inlet 152 permits the introduced well bore fluid to drive the movement of the formation water past and through the electrodes. The fluid movement facilitates both electrolysis by ensuring a continuous supply of fresh formation water and the release of the product gas bubbles from the electrodes into the newly formed production fluid. The space between each opposing electrode is such that electrical current does not pass from one electrode to the other before inducing electrolysis in the formation water between the electrodes.

The electrodes may have any shape or configuration, including bar, rod, mesh, curved, flat sheet and films. The electrodes can be porous or solid. Complex and three-dimensional geometries increase the fluid contact surface area and may improve the electrolysis efficiency. Examples of increased current density electrodes include clusters of thin rods and spirals; meshes; bundles of microfibers and woven strands; wrapped and unwoven wire bundles; open-cellular structures akin to reticulated vitreous carbon (RVC); arrays of single and multi-walled tubes and cylinders, including carbon nanotubes; spheroids inside a fluidly communicative container; and porous particles with increased surface area, granules and powders, including graphitized mesoporous carbons (GMCs).

Given the constraints of space within the interior of electrochemical apparatus 102, an embodiment of electrochemical apparatus 102 includes where the electrode pair couple to one another through an electrically insulating material. The coupling must ensure that electrical current does not leak between the anode and the cathode or the electrical potential, and therefore the means for generating product gas, is defeated. For example, an anode and a cathode, preformed into two semi-circular sheets having a radius that is less than the interior radius of electrochemical apparatus 102 and coupled together with an insulating polymer material, may form a ring by which well bore fluid and production fluid may flow axially between the sheets as well as between the ring and the interior wall of electrochemical apparatus 102. Another example of such an electrode ring can include holes in each electrode to permit fluid flow along the length of the ring.

The electrodes may comprise a variety of known compositions, including metals, metal oxides, carbon, conductive polymers, semiconductors and ceramics. Metals include titanium, iron, copper, platinum (with iridium or rubidium for added strength), nickel, zinc, tin and stainless steel. Metal electrodes may incorporate mixed metal oxides (MMOs) to improve selectivity and longevity. Carbon-based electrodes include particle carbon, pre-treated naturally occurring graphite and artificially created graphite (for example, carbonizing petroleum coke, oil or coal tar pitch).

Ion Exchange Membrane

An embodiment of electrochemical apparatus 102 includes ion exchange membrane 172 that is a cation exchange membrane. The cation exchange membrane is an ion exchange membrane that only permits one-way ion communication—cations—between the anode and the cathode. Anions cannot pass through the cation exchange membrane. An example of a cation exchange membrane includes NAFION perfluorinated materials (E. I du Pont de Nemours and Co.; Wilmington, Del.). An embodiment of electrochemical apparatus 102 includes an ion exchange membrane 172 that is an anion exchange membrane.

Operation

In an example of operation, electrochemical apparatus 102 is located within injection well bore 104. Water of water bearing formation 110 can enter interior 129 of electrochemical apparatus 102 through inlet 152. Electrical power is generated by solar photovoltaic panel 142. The electrical power is introduced to electrochemical apparatus 102 so that a portion of the formation water is converted into a product gas that can include hydrogen gas and oxygen gas. The product gas can form product gas bubbles 170. Product gas bubbles 170 exit electrochemical apparatus 102 through exit openings 171.

After exiting electrochemical apparatus 102, product gas bubbles 170 travel in a direction generally towards surface 106 and into hydrocarbon formation 120. Product gas bubbles 170 react with reservoir hydrocarbons within hydrocarbon formation 120 to form a production fluid that enters production well bore 118. The production fluid within production well bore 118 is produced to the surface.

Product gas bubbles 170 are able to improve the recovery factor of hydrocarbon formation 120. The recovery factor is the amount of hydrocarbon that can be produced from a reservoir, normally expressed as a percentage of the total amount of hydrocarbon in place in the reservoir. As an example, the recovery factor of hydrocarbon formation 120 can be improved by product gas bubbles 170 by lightening the reservoir hydrocarbons and reducing the viscosity of the reservoir hydrocarbons. Hydrogen of product gas bubbles 170 can break down heavy hydrocarbon molecules into smaller ones with lower viscosity.

The recovery factor of hydrocarbon formation 120 can also be improved by product gas bubbles 170 by altering the permeability of hydrocarbon formation 120. Rock permeability depends on fluid viscosity; the lower the viscosity of the fluid the higher the permeability of the rock for that fluid. The recovery factor of hydrocarbon formation 120 can further be improved by product gas bubbles 170 by altering the wettability of hydrocarbon formation 120. The more gas being transmitted through hydrocarbon formation 120, the more gas-wet the wettability of hydrocarbon formation 120 will become and as a result, the more oil will be transmitted through rock, resulting in improved oil mobility. In addition, the recovery factor of hydrocarbon formation 120 can be improved by product gas bubbles 170 by increasing a pressure within hydrocarbon formation 120. As gas is introduced into hydrocarbon formation 120, the pressure of hydrocarbon formation 120 will be increased to provide energy to hydrocarbon formation 120. The use of the formation water to form the produce gas also reduces the adverse effect of water encroachment into production well bore 118. Water will be consumed by the electrolysis process and become gas, reducing the amount of water in hydrocarbon formation 120 and reducing potential water encroachment.

Experimental Results

Laboratory simulation of thermal treatment of heavy crude oil with a specific gravity (at 15.6° C.) of 0.89 and containing high boiling compounds under hydrogen pressure was carried out by loading 60 grams of crude into a 150 milliliter (ml) stainless steel autoclave reactor vessel, purged several times with nitrogen gas to remove air and moisture in the reaction system, then pressurized with hydrogen gas to 230 pounds per square inch (psi) at room temperature. The reactor was then heated to 400° C. at a heating rate of 10 degrees Celsius per minute (° C./min) with stirring at 102 revolutions per minute (rpm). The reactor was maintained at the pressure of 1000 psi and temperature of 400° C. for 12-16 hours, which caused the conversion of the poly-aromatics into solid coke via cross-linking and poly-condensation reactions. Once the reaction was stopped, the reactor was allowed to cool to room temperature.

The resulting product consisted of 12.3 weight percent (wt %) (3.5 grams) gas composed of more than 90 wt % methane, 6 wt % ethane, 3 wt % propane and trace amounts heavier hydrocarbons and mercaptants; 19.6 wt % (5.6 grams) solid composed mainly of mesophasic carbon; and 68.1 wt % (19.4 grams) liquid. The viscosity of the resulting liquid product was found to be less than that of untreated heavy crude, as listed in Table 1. The reduction in viscosity was due to the removal of asphaltene and resins by converting the asphaltene and resins into solid coke.

TABLE 1

Viscosity values measured at 22° C.

| Sample | Viscosity, millipascal seconds (mPa · s) |
|---|---|
| Untreated heavy oil | 29.4 |
| Thermally treated heavy oil under hydrogen pressure | 2.8 |

Simulated distillations were performed using Agilent 7890B GC system with SimDis software employing the HT750A analysis (Agilent; Santa Clara, Calif.). Simulated distillation of the resulting liquid product, shown in FIG. 4, reveals the formation of a resulting liquid product with a reduced maximum boiling point compared to the boiling point of the untreated crude. This observation is also attributable to the removal of significant amounts of the heavy crude components that have increased boiling points, thus producing a cleaner and higher quality crude. As an example, looking at the data point of 99 percent (%) recovery, the resulting liquid product has a boiling point of 466° C., and the untreated crude has a boiling point of 703° C.

Figure 4:
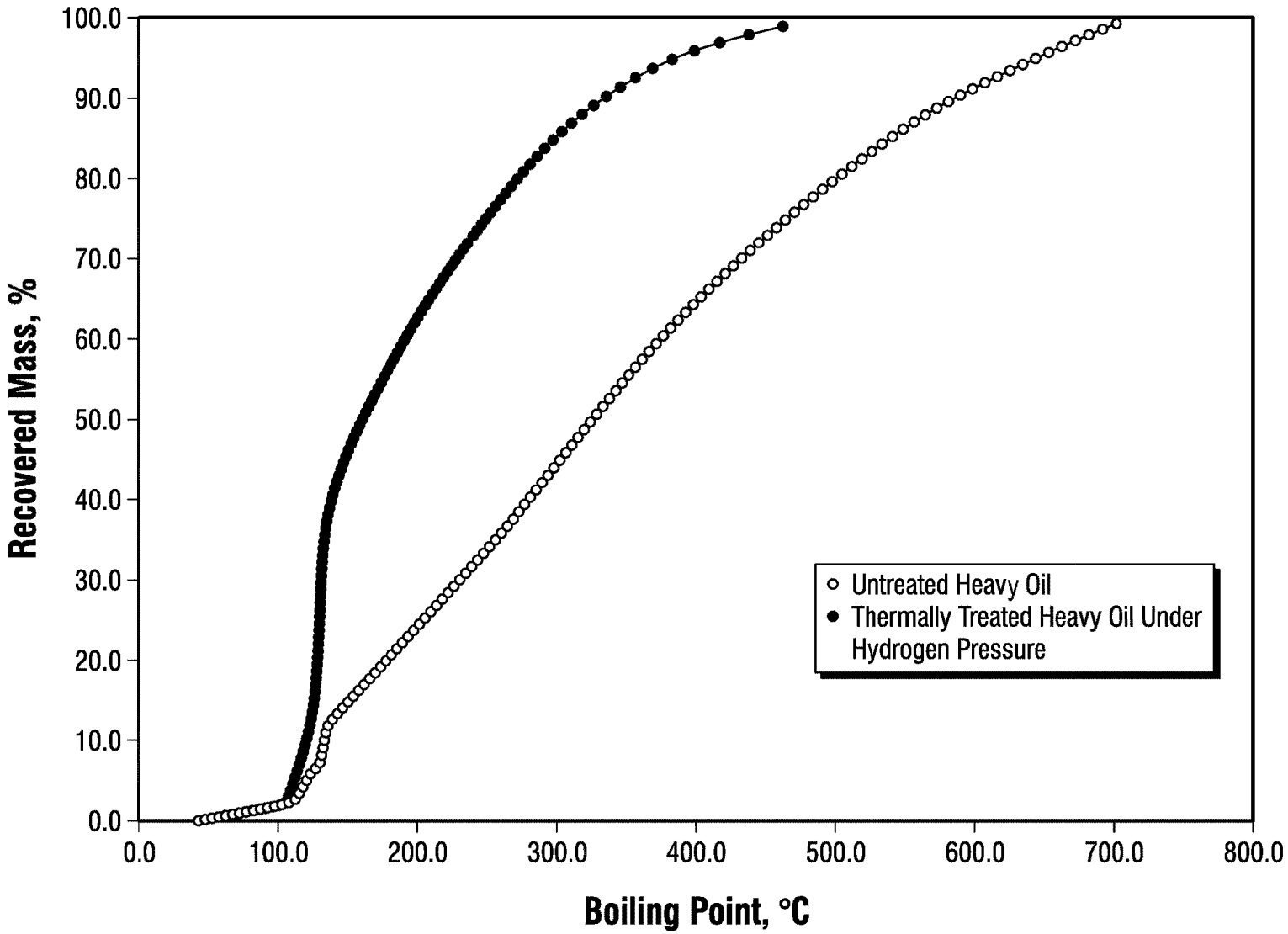
FIG. 4 shows the boiling point of a) heavy crude oil and b) thermally treated heavy crude oil under hydrogen.

The thermal treatment was applied to heavy crude that contained significant amounts of high molecular weight hydrocarbon species, such as reside and asphaltenes, as reflected in the relatively high viscosity value shown in Table-1 and the relatively high boiling point range shown in FIG. 4. The heavy crude that was treated resulted in a product of three physically distinct phases: solid, liquid and gas. The viscosity and boiling point of the liquid component that resulted from the thermal treatment was lower than that of the original crude. The lower viscosity and boiling point were a result of a quantity of the high molecular weight hydrocarbon species present in the untreated heavy crude forming the solid phase of the resulting product, leaving only the relatively smaller, lower molecular weight hydrocarbon species in the liquid phase. As a result, a higher value liquid product was obtained.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method of enhancing oil recovery with an electrochemical apparatus, the method including:

introducing the electrochemical apparatus into an injection well bore, where the electrochemical apparatus includes an anode, a cathode and an interior wall, where the interior wall defines an interior that contains both the anode and the cathode;

operating the electrochemical apparatus such that injection water of the injection well bore is introduced into the interior of the electrochemical apparatus;

introducing electrical power to the electrochemical apparatus such that a portion of the injection water undergoes electrolysis and is converted into a product gas, where the product gas includes hydrogen gas and oxygen gas; and operating the electrochemical apparatus such that the product gas forms product gas bubbles and the product gas bubbles travel into a hydrocarbon bearing formation, where a hydrogen of the product gas bubbles react with a reservoir hydrocarbon of the hydrocarbon bearing formation, breaking down certain heavy hydrocarbon molecules of the reservoir hydrocarbon with the product gas into smaller hydrocarbon molecules with a lower molecular weight to form a production fluid with a lower viscosity so that the wettability of the hydrocarbon bearing formation is altered by making rock of the hydrocarbon bearing formation more gas wet, improving oil mobility and improving a recovery factor of the hydrocarbon formation, where the production fluid with the lower viscosity is produced through a production well bore that is mechanically separate from any component of the electrochemical apparatus.

2. The method of claim 1, where the production well bore includes a production zone within the hydrocarbon bearing formation that is spaced apart from and closer to an earth's surface than a section of the injection well bore that is located within a water bearing formation.

3. The method of claim 1, where a viscosity of the production fluid is less than the viscosity of the reservoir hydrocarbon.

4. The method of claim 1, where a boiling point of the production fluid is less than the boiling point of the reservoir hydrocarbon.

5. The method of claim 1, further including providing energy to the reservoir hydrocarbon with a pressure of the product gas bubbles.

6. The method of claim 1, further including providing the electrical power from a solar photovoltaic panel.

7. A method of enhancing oil recovery with an electrochemical apparatus, the method including:

introducing the electrochemical apparatus into an injection well bore such that the electrochemical apparatus is located in a water bearing formation, where a fluid within the water bearing formation includes injection water, and where the electrochemical apparatus includes an anode, a cathode and an interior wall, where the interior wall defines an interior that contains both the anode and the cathode;

operating the electrochemical apparatus such that the injection water is introduced into the interior of the electrochemical apparatus;

introducing electrical power from a solar photovoltaic panel to the electrochemical apparatus such that a portion of the injection water undergoes electrolysis and is converted into a product gas, where the product gas includes hydrogen gas and oxygen gas; and operating the electrochemical apparatus such that the product gas forms product gas bubbles and the product gas bubbles travel into a hydrocarbon bearing formation, where the hydrogen gas reacts with a reservoir hydrocarbon of the hydrocarbon bearing formation, breaking down certain heavy hydrocarbon molecules of the reservoir hydrocarbon with the product gas into smaller hydrocarbon molecules with a lower molecular weight to form a production fluid with a lower viscosity so that the wettability of the hydrocarbon bearing formation is altered by making rock of the hydrocarbon bearing formation more gas wet, improving oil mobility and improving a recovery factor of the hydrocarbon formation, where the production fluid with the lower viscosity is produced through a production well bore that is mechanically separate from any component of the electrochemical apparatus, where the hydrocarbon bearing formation is spaced apart from and closer to an earth's surface than the water bearing formation.

8. The method of claim 7, where a viscosity of the production fluid is less than the viscosity of the reservoir hydrocarbon.

9. The method of claim 7, where a boiling point of the production fluid is less than the boiling point of the reservoir hydrocarbon.

10. The method of claim 7, further including providing energy to the reservoir hydrocarbon with a pressure of the product gas bubbles.

* * * * *